US006135015A

United States Patent [19]

Mendez

[11] Patent Number: 6,135,015

[45] Date of Patent: Oct. 24, 2000

[54] INDUSTRIAL APPARATUS FOR THE ASEPTIC PACKAGING OF PERISHABLES TO EXTEND SHELF LIFE WITHOUT REFRIGERATION

[76] Inventor: Alejandro Mendez, P.O. Box 523271, Miami, Fla. 33152-3271

[21] Appl. No.: 09/393,412

[22] Filed: Sep. 10, 1999

Related U.S. Application Data

[63] Continuation-in-part of application No. 09/309,387, Jun. 18, 1998, which is a continuation-in-part of application No. 08/823,813, Mar. 24, 1997, abandoned, which is a continuation of application No. 08/442,188, May 16, 1995, Pat. No. 5,614,238.

[51] Int. Cl.[7] ..... A23B 7/005

[52] U.S. Cl. ..... 99/453; 99/483; 99/451; 99/367; 99/362; 426/397; 426/399; 426/401

[58] Field of Search ..... 99/359, 361, 362, 99/367, 451, 452, 453, 483; 426/397, 399, 401, 403, 407, 416, 521, 599, 615

[56] References Cited

U.S. PATENT DOCUMENTS

| | | | |
|---|---|---|---|
| 2,561,784 | 7/1951 | Garcia | 426/397 |
| 2,829,058 | 4/1958 | Kazmi | 426/397 |
| 3,799,220 | 3/1974 | Berry et al. | 99/453 X |
| 4,441,406 | 4/1984 | Becker et al. | 99/275 |
| 4,552,190 | 11/1985 | Wilson et al. | 99/453 X |
| 5,048,404 | 9/1991 | Bushell et al. | 99/451 |
| 5,229,152 | 7/1993 | Meldrum | 426/327 |
| 5,235,905 | 8/1993 | Bushnell et al. | 99/451 |
| 5,320,856 | 6/1994 | Veronesi et al. | 426/392 |
| 5,324,528 | 6/1994 | Wright et al. | 426/324 |
| 5,327,818 | 7/1994 | Olivetti | 99/453 X |
| 5,614,238 | 3/1997 | Mendez | 426/397 |

OTHER PUBLICATIONS

"Dairy Industry", 666. (date unknown).
"Citrus Fruits and Processing", pp 415–425 (date unknown).
"Thermal (Heat Preserving", pp 2006–2014 (date unknown).
"Food Preservation" pp 1015–1025 (date unknown).
Rombauer, et al. *Joy of Cooking,* 1931, pp 803–805 (date unknown).

*Primary Examiner*—Reginald L. Alexander
*Attorney, Agent, or Firm*—Brinkley, McNerney, Morgan, Soloman & Tatum, LLP

[57] ABSTRACT

A process that kills, or renders organically inactive, one-hundred percent of the bacteria and enzymes, as well as any other non-pathogenic microorganisms present in fresh squeezed citrus and non-citrus fruit juices and fruit juice blends, as well as fruit pulps, and dairy products. The process results in the aseptic packaging of one hundred percent natural juices and milk having a shelf life extending from two to three years without the need for refrigeration, and without the use of artificial preservatives or additives. The process also preserves the natural taste, colors, and odors typically found in fresh squeezed juices and juice blends, an citrus pulp. The invention additionally encompasses an industrial apparatus kills, or otherwise deactivates the enzymes, bacteria, and microorganisms that cause spoilage in perishables such as fruit juice, fruit juice blends, fruit pulp, wines, milk, chocolate milk, butter, yogurt, cultured milk products, beer, malt and oat beverages, soups, and soft drinks. The industrial apparatus is capable of large batch processes and continuous operation. The perishables treated by the industrial apparatus have shelf lives that extend from two to three years without refrigeration and preservatives. The device also preserves the original natural taste, color, odor, and flavor found in these perishables when fresh.

18 Claims, 7 Drawing Sheets

FIGURE 10.

THE INACTIVATION OF ENZYMES AS A FUNCTION OF TEMPERATURE

| Temperature Range (°C) | Inactivated Enzymes (%) |
|---|---|
| 30 - 50 | 20 |
| 50 - 60 | 30 |
| 60 - 70 | 50 |
| 70 - 80 | 70 |
| 80 - 90 | 90 |
| 90 - 95 | 100 |

INDUSTRIAL APPARATUS FOR THE ASEPTIC PACKAGING OF PERISHABLES TO EXTEND SHELF LIFE WITHOUT REFRIGERATION

CROSS-REFERENCES TO RELATED APPLICATIONS

This application is a continuation-in-part of application Ser. No. 09/309,387, filed Jun. 18, 1998, which is a continuation-in-part of application Ser. No. 08/823,813, filed Mar. 24, 1997, abandoned, which is a continuation of application Ser. No. 08/442,188, filed May 16, 1995, U.S. Pat. No. 5,614,238.

BACKGROUND OF THE INVENTION

1. Field of the Invention

The present invention is directed to an industrial apparatus for preserving perishables, such as fresh squeezed citrus and non-citrus fruit juices, fruit juice blends, fruit pulp, dairy products, barley products, soups, and soft drinks. More particularly, the industrial apparatus enables a thermal preservation process for aseptically packaging perishables without adding preservatives.

The invention also encompasses an industrial apparatus for treating perishable products (including fruit juice, fruit juice blends, fruit pulp, wines, milk, chocolate milk, butter, yogurt, cultured milk products, beer, malt and oat beverages, soups, and soft drinks) in order to extend their shelf-life.

2. Description of the Prior Art

When fruits are harvested, microbiological and chemical changes occur which limit the time the fruit remains acceptable to the consumer and is safe for consumption. Since most of the post-harvest changes in food lead to spoilage, various methods of food preservation are used to prolong the length of time for which the foods retain their original quality and appeal.

In the days of simple farming communities, the population lived on locally grown fruits and vegetables. As a result, no highly organized methods of food preservation were necessary.

In the modern world however, centers of world population are in towns and cities, that are often many miles from the main areas of food production. To provide unspoiled food to these distant consumers, methods and chemicals were developed to preserve food. Unfortunately, long-term tests have shown how these same chemicals can harm the very people intended to be protected.

After harvesting, plant tissue is unable to prevent the attack of microorganisms such as bacteria, yeast, and molds, which break down the food structure and produce undesirable "off-flavors," discoloration, and odors. The number of organisms in an ounce of food can range from several hundred to twenty million or more and the organisms are capable of rapid multiplication, such that under certain conditions, their numbers can double every fifteen or twenty minutes.

Bacteria are minute microorganisms that are the most common cause of food spoilage. Bacteria also can render the food unpleasant to eat. And, in the case of pathogenic bacteria, such as *Staphylococcus aureus* or *Clostridium botulinum*, bacteria may cause far worse effects including food poisoning.

Food spoilage is also caused by chemical substances known as enzymes which are always present in minute quantities in living materials. Enzymes are proteins that catalyze biochemical reactions. Enzymes catalyze the chemical reactions that change the flavor and texture of fruits during ripening. Enzymes are also responsible for the deterioration of fruits after harvesting, such as the browning of the cut surface of apples and pears caused by the oxidation of phenols by the enzyme phenolase.

Because enzymes are proteins, enzymes are heat sensitive. Most proteins irreversibly denature when heated above normal biological temperatures. When proteins denature, they unravel and lose their three-dimensional shape. Because the ability to catalyze reactions depends on shape, once enzymes are heated, they usually lose their ability to catalyze reactions.

Thermal preservation techniques for rendering inactive bacteria and enzymes in fruit juices and citrus pulp typically rely on known, large-scale, pasteurization techniques. Pasteurization is a heat treatment process, wherein a supply of food product is heated in stainless steel containers at temperatures normally less than 212° F. (100° C.). Although common pasteurization techniques destroy pathogenic organisms, they do not provide indefinite protection against microbiological spoilage. Products that have been pasteurized need to be refrigerated immediately. Pasteurization extends shelf life to four to seven days in diary products and four to six weeks in fruit products.

Even an acidic product, such as fruit juice, requires protection from spoilage organisms such as acetobacter, whose growth can lead to cloudiness in the fruit juice product. Cloudiness in some citrus juice products is due to the presence of pectin, which occurs naturally in the fruit. If the natural pectolytic enzymes of the fruit are not destroyed, they degrade the pectin with the result that the juice becomes cloudy and often gels. Therefore, in order to destroy the pectolytic enzymes, most citrus juices are processed by flash pasteurizing in a plate heat exchanger at 203° F. (95° C.) for 30 seconds. However, while partially rendering enzymes organically inactive, this process degrades juice quality since the juice in contact with metallic heat exchanger elements reach temperatures above 100° C. The product that directly contacts the heating surface may actually become cooked if exposed to heat for more than thirty seconds. Cooking causes irreversible changes in the taste, color, and odor of food. Furthermore, the prior art methods have been found unsatisfactory for rendering the enzymes present in citrus and non-citrus fruit juices organically inactive or destroying bacteria and other pathogenic and non-pathogenic organisms. The short shelf life of pasteurized products evinces the shortcomings of current methods.

Placing heating elements in direct contact with malt beverages also may alter the taste, color, and odor. When malt beverages such as beer are directly heated by heating elements that are above one-hundred-sixty-five degrees centigrade (165° C.), the original taste becomes affected. To prevent overheating, malt beverages may not be fully pasteurized with the result that many harmful bacteria and enzymes remain. Fresh barley products have a similar shelf life to milk.

Pasteurization techniques do not render one-hundred percent of the enzymes in these products organically inactive. As a result, certain fruit juices have not been made readily available to the consuming public due to the limited success of the prior art methods. For example, juices such as watermelon juice, banana juice, grape juice, and pineapple juice are not found on store shelves packaged in a one hundred percent natural state. Oftentimes, the juice quality is compromised by the addition of various preservatives to maintain freshness and color.

Fresh dairy products may be more sensitive to enzymes than fruit products. Pasteurized milk only lasts four to seven days even when refrigerated.

Thus, a need still exists for an industrial apparatus for the thermal processing of fresh fruit products, fresh dairy products, and fresh barley products which will result in the aseptic packing of these products without the addition of preservatives to extend the shelf life of the products up to two to three years without refrigeration.

SUMMARY OF THE INVENTION

The instant invention teaches a process that effectively kills, or renders organically inactive, one-hundred percent of the bacteria and enzymes, as well as any other non-pathogenic microorganisms present in fresh squeezed citrus and non-citrus fruit juices and fruit juice blends, as well as fruit pulps, wines, dairy products such as milk, barley products such as beer, soups, and soft drinks. The process results in the aseptic packaging of natural juices having a shelf life extending from two to three years without the need for refrigeration or artificial preservatives. The industrial apparatus and process also preserves the natural taste, colors, and aromas typically found in fresh squeezed juices, juice blends, and fruit pulp, while avoiding the disadvantages of overheating experienced in plate heat exchangers.

The process includes the following steps: extracting the juice or pulp (hereinafter "juice") in a conventional manner using a juice extractor; placing the extracted juice immediately into temperature-resistant containers capable of withstanding temperatures greater than 100° C.; submerging substantially the containers in a tank of water at room temperature; raising the temperature of the water in the tank to 100° C. within a time period between five and ten minutes (5–10 min); monitoring the juice temperature until the juice reaches a minimum temperature of 92° C. and a maximum temperature of 97° C.; allowing the juice to remain at a temperature between 92° C. and 97° C. for a time between one and two minutes (1–2 min.); removing the containers from the water; capping the containers in an airtight manner; cooling the containers to approximately 35° C. by suitable means such as rinsing with room-temperature water and passing cold air, thereby causing a vapor lock inside the individual containers caused by the volumetric contraction of the enclosed vapor during cooling, and preventing continued heating. In addition, the process may add the following steps: stabilizing the juice for three days; checking for fermentation, contamination, leaks, or other defects by confirming the vapor lock that has been maintained; and labeling, boxing, and shipping the containers for consumption.

The invention can apply the principles taught in U.S. Pat. No. 5,614,238 (obtained by the same inventor) to a process wherein massive amounts of fresh perishables are preserved. These perishables include fresh fruit products, fresh dairy products, fresh barley products, soups, and soft drinks. The invention encompasses an industrial apparatus that allows the processing of massive amount of fresh perishables. Also, this industrial apparatus permits the aseptic packaging of larger container sizes. Also, since the product is never in direct contact with the heat source, the perishables retain their natural aroma, flavor, color, and appearance.

The invention encompasses the following industrial apparatus and methods. The perishables are placed in a tank. The tank is jacketed. In the jacket, a heating medium is enclosed. The heating medium is preferably a high thermal capacity material that is a liquid between room temperatures and 100° C. Preferably, the heating medium is water but other products can be utilized, such as ethylene glycol and mineral oil. The heating medium is directly heated by a heat source. The heat source can be any heating device such as a heating coil or steam boiler. Because the perishable is heated by the heating medium which, in turn, is heated by the heat source, the perishable can be said to be heated "indirectly" by the heat source. In contrast, the heating medium which is in contact with the heat source can be said to be heated "directly" by the heat source. By indirectly heating the perishable, the perishable is never exposed to the extreme heat of the heat source. Another advantage of using a heat medium is that it provides a large, efficient heat sink through which large amounts of thermal energy can be quickly transferred.

To guarantee that all of the perishables in the tank are properly heated, the tank can include a means for mixing the perishables. The means for mixing include an agitator, internal baffles to create mixing during flow, and villi which increase the surface to volume ratio to enhance heat transfer. The industrial apparatus includes temperature sensor to monitor the temperature of the perishable throughout the process.

After heating, the product is hot bottled, capped, cooled, and labeled in a typical fashion to create a vacuum sealed product.

The invention can be a batch process. In a batch process the tank is filled with perishables, the perishables are heated, and then the entire tank is emptied and the perishable is dispatched for bottling.

The invention can be a continuous process. In a continuous process, the perishable is flowed continuously through the tank. The flow, mixing, and heat exchange is controlled within the tank so that whenever a perishable is flowed through the tank, it exits having been fully heated according to the method described in the previous paragraphs. Throughout the continuous process, perishables flow into and out of the tank. By being a continuous process that constantly produces treated perishables, the filler can be operated constantly without a wait between batches.

The invention lengthens the shelf life of the perishables including the following products: fruit juice, fruit juice blends, fruit pulp, wines, milk, chocolate milk, butter, yogurt, cultured milk products, beer, malt and oat beverages, soups, and soft drinks.

Therefore, an object of the instant invention is to provide a thermal preservation method for products such as citrus and non-citrus fruit juices, fruit juice blends, and fruit pulps, whereby one-hundred percent natural juice or pulp products may be aseptically packaged in air tight containers having an extended, non-refrigerated, shelf life of at least two years.

A further object of the instant invention is to provide a thermal preservation method whereby juice and pulp products are prevented from overheating contact with heat exchanging industrial apparatus.

Yet another object of the instant invention is to provide a thermal preservation process whereby juice and fruit pulp products are packaged prior to exposure to raised temperatures.

Still another object of the present invention is to provide a thermal preservation process whereby pre-packaged juice or pulp containers vents vapor during the heating process and create a vapor lock during the cooling process.

Yet another object of the instant invention is to provide a thermal preservation process suitable for use with perishables such as fruit juice, fruit juice blends, fruit pulp, wines, milk, chocolate milk, butter, yogurt, cultured milk products, beer, malt and oat beverages, soups, and soft drinks.

An object of the invention is to provide an industrial apparatus that can aseptically package perishables wherein the speed of the device is not limited by the time of heating and cooling the containers.

An object of the invention is to provide an industrial apparatus wherein full containers need not be dipped and lifted in a bath for heating and cooling.

An object of the invention is to provide an industrial apparatus that denatures the enzymes in perishables that are responsible for spoilage while not affecting the taste, color, and aroma of the fresh perishable.

An object of the invention is to provide an industrial apparatus capable of continuously processing perishables so as to lengthen their shelf life.

In accordance with these and other objects which will become apparent hereinafter, the instant invention will now be described with particular reference to the accompanying drawings.

BRIEF DESCRIPTION OF THE DRAWINGS

FIG. 9 is a schematic diagram of an industrial apparatus capable of processing large amounts of perishables.

FIG. 10 is a table showing the deactivation of enzymes as a function of the product being heated to different temperatures.

DESCRIPTION OF THE PREFERRED EMBODIMENTS

The invention encompasses a process that kills, or renders organically inactive, one-hundred percent of the bacteria and enzymes, as well as any other non-pathogenic microorganisms present in fresh squeezed citrus and non-citrus fruit juices and fruit juice blends, as well as fruit pulps, wines, milk, chocolate milk, butter, yogurt, cultured milk products, beer, malt and oat beverages, soups, and soft drinks. The process results in the aseptic packaging of one hundred percent natural juices having a shelf life extending from two to three years without the need for refrigeration, and without the use of artificial preservatives or additives. The process also preserves the natural taste, colors, and odors typically found in fresh squeezed juices and juice blends, and fruit pulp.

Figures 1, 2, 3:
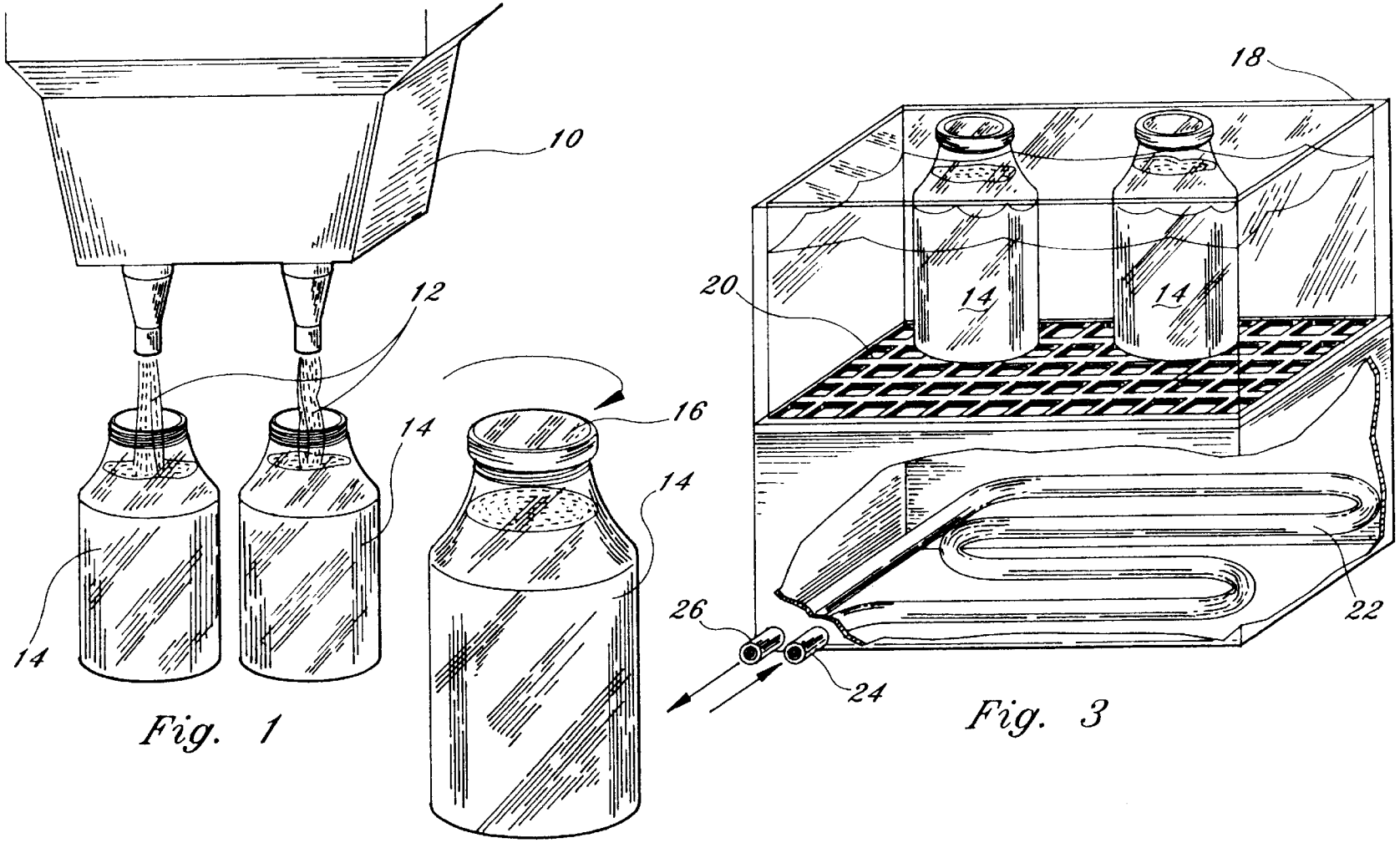
FIG. 1 illustrates the container filling procedure.
FIG. 2 illustrates capping of a container.
FIG. 3 illustrates the containers submerged into a water bath and heating procedure wherein the water temperature is raised.
Figure 8:
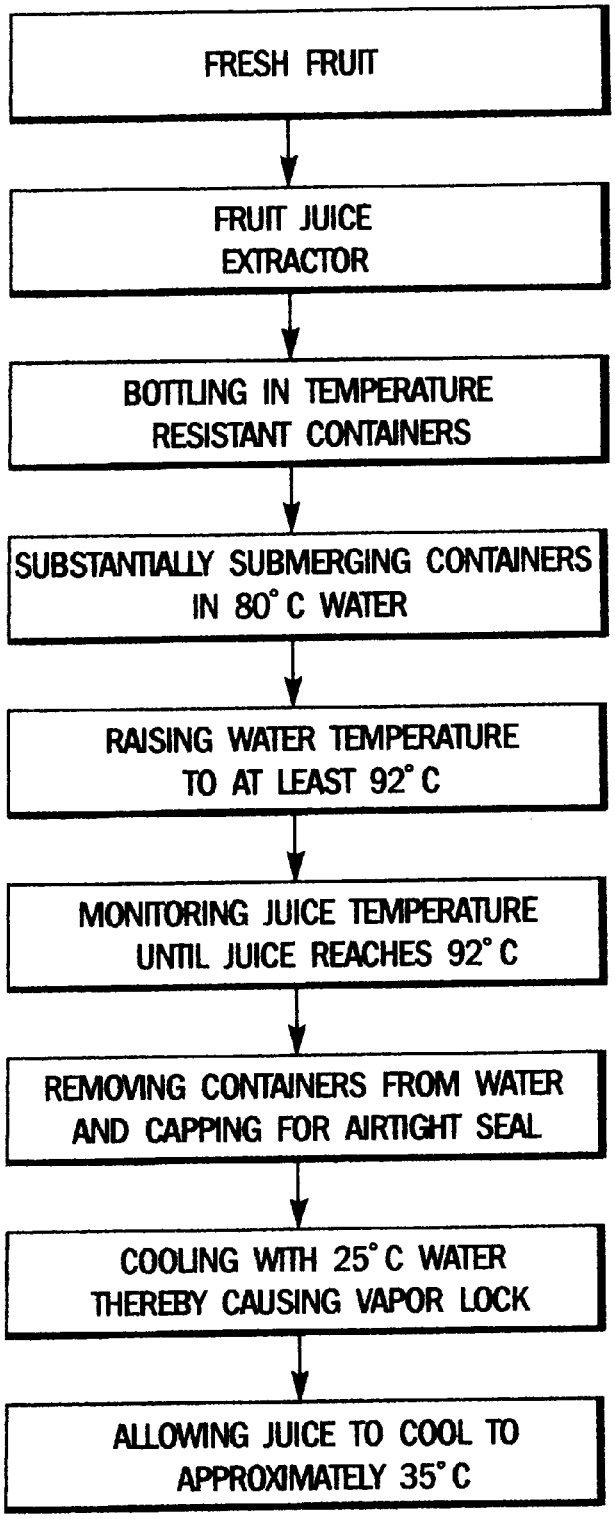
FIG. 8 is a flow chart of the instant process.
Figure 5:
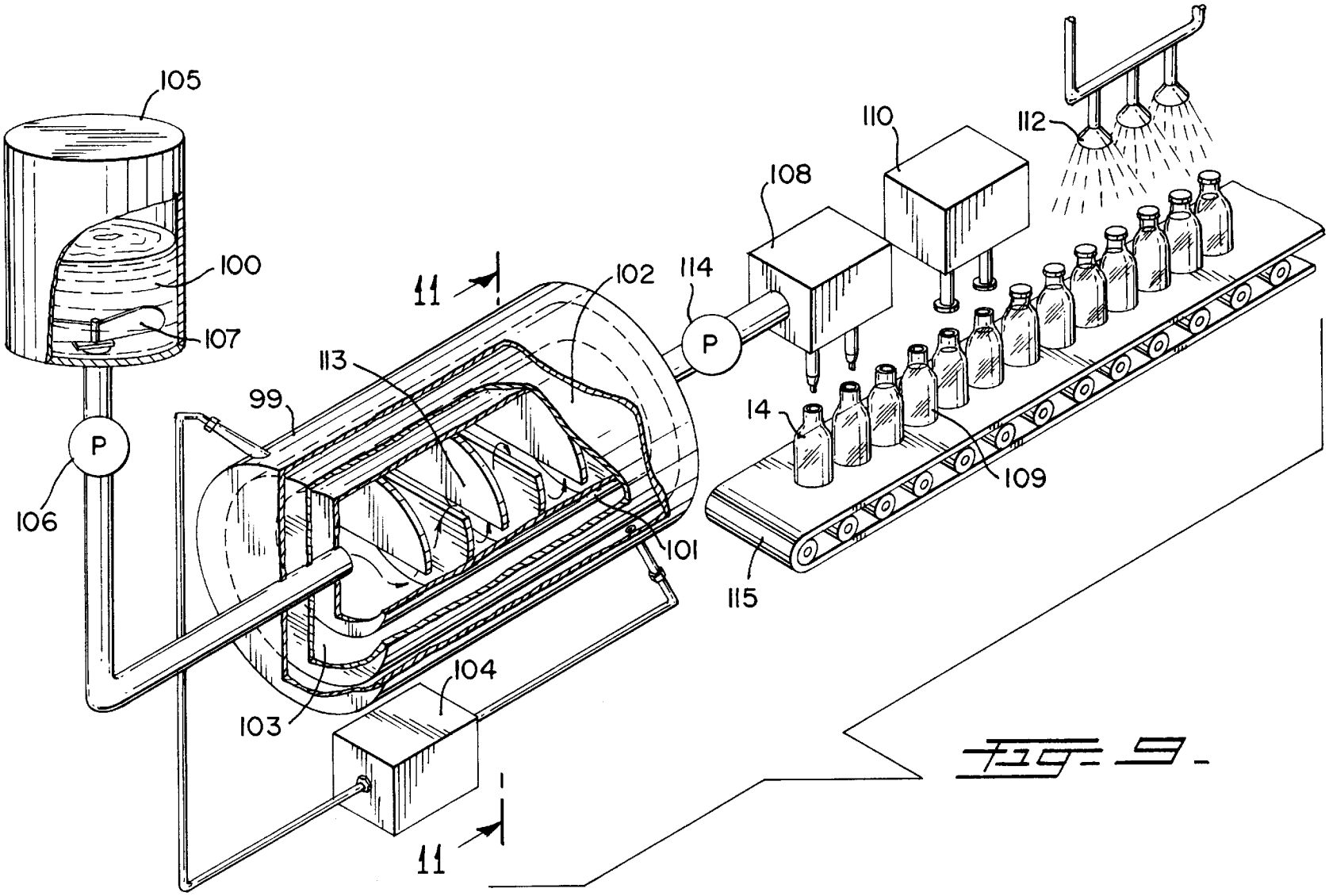

FIG. 8 is a flow chart of the process taught by the instant invention. The process includes the following steps. Extracting the juice or pulp using an appropriate extracting device as illustrated in FIG. 1. For example, a citrus juice extractor 10 may be utilized to extract juice and pulp from citrus including oranges, tangerines, and grapefruit. On the other hand, fruit, such as bananas, may require more specialized extracting devices. Regardless of the extraction method, one-hundred percent natural juice or pulp, shown generally as 12, is obtained.

The extracted juice, juice blend, or fruit pulp (hereinafter "product") is immediately bottled in temperature-resistant containers 14 such as thermoplastic capable of withstanding temperatures possibly exceeding one-hundred degrees celsius (100° C.). Temperature-resistant polymeric containers are particularly well suited for use with the instant process since the polymeric wall acts as a thermal insulator that protects the product from exposure to the extreme surface temperatures experienced while heating the product in a thin wall stainless steel container or plate heat exchanger. Polymeric containers are also able to withstand thermal expansion better than other possible materials such as glass.

As best seen in FIG. 2, the filled containers 14 may be capped with a suitable commercial cap 16, however, in the preferred embodiment the containers are not initially capped. In addition, as an alternative, the containers may be "partially capped" which refers to capping the container by imparting a partial turn to the cap such that the cap is semi-sealed and vapor and gas remaining in the container may escape during expansion.

As best shown in FIG. 3, the containers 14 are then substantially submerged in a tank 18 of water which is initially at room temperature. It has been found that submerging the container such that the exterior water level reaches approximately two-thirds to three-quarters of the container height is optimum. Tank 18 is preferably constructed having an elevated, or double bottom, shown as 20, for elevating the containers above a heat exchanging means 22. In the preferred embodiment, the heat exchanging means includes a steam heat exchanger, having a steam inlet 24 and a steam outlet 26, submerged within tank 18 with heat supplied by superheated steam.

The temperature of the water in the tank is then raised to eighty degrees centigrade (80° C.) over a period of approximately five (5) minutes. Thereafter, the temperature of the water in the tank is further raised to at least ninety-two degrees centigrade (92° C.) over an additional two minute (2 min.) period. As the temperature of the water in the tank is uniformly raised, temperature sensors (not shown) monitor the product temperature. To insure uniform heating, the product may be mixed by agitating the containers. The heat transfer process is terminated when the juice product reaches ninety-two degrees centigrade (92° C.). The product should not be heated above ninety-seven degrees centigrade (97° C.). The juice product, however, may be maintained at that temperature for a few (1–3) minutes, depending on the product to deactivate organic matter such as bacteria and enzymes.

Figure 5:
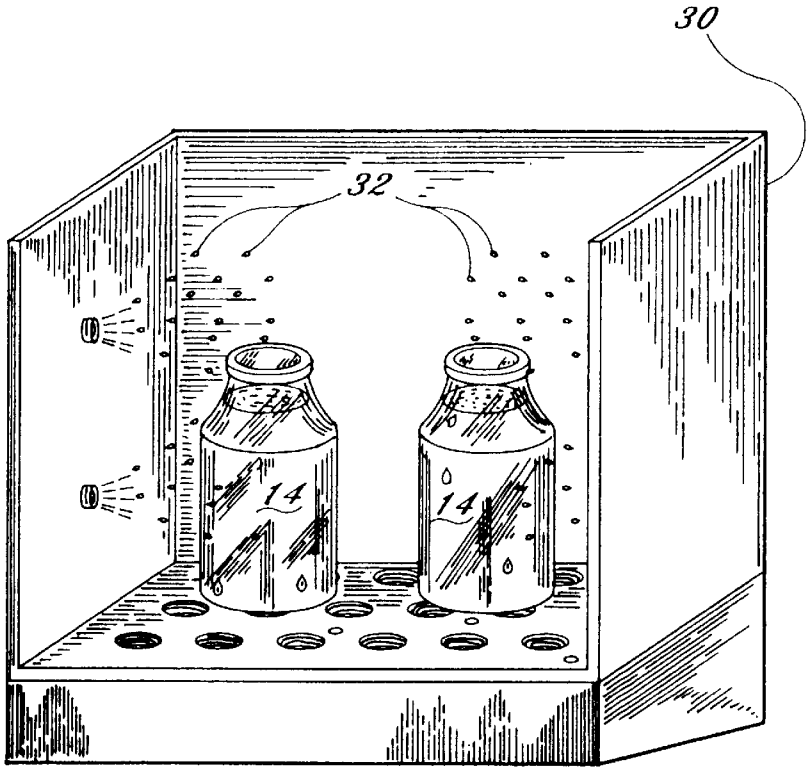
FIG. 5 illustrates cooling the containers with a water spray.
Figure 4:
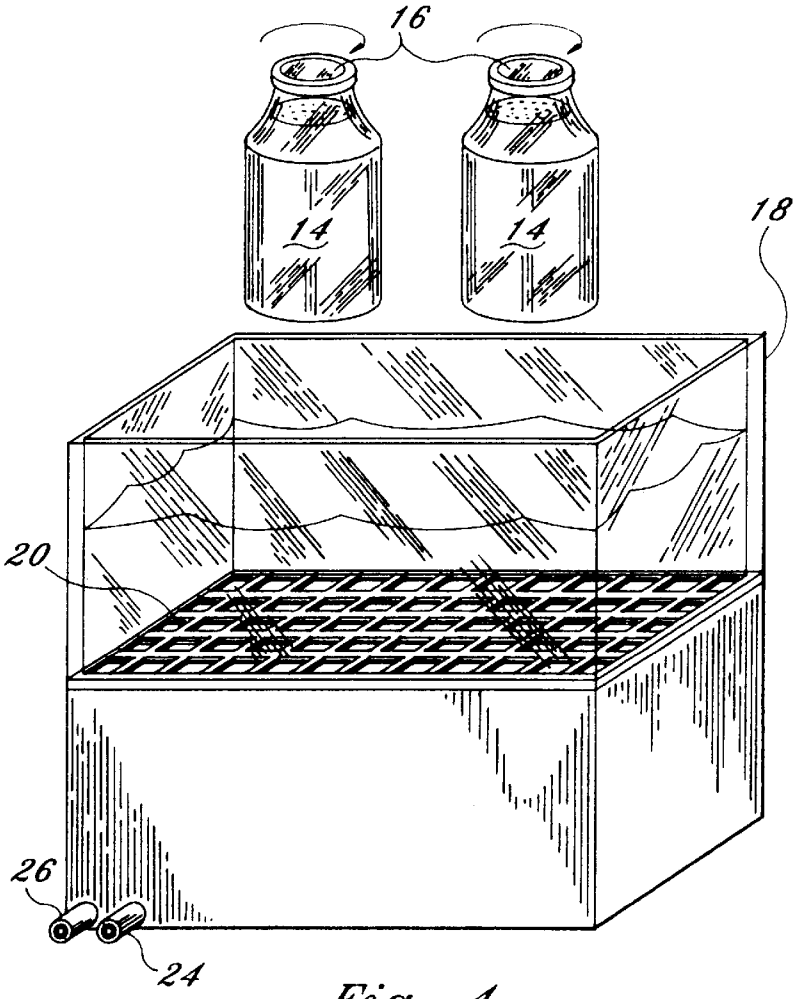
FIG. 4 illustrates a capping process forming an air tight seal.

The containers are then removed from the tank and capped if previously left uncapped, or "totally capped" as best illustrated in FIG. 4 if the partial capping method is used. "Totally capped" is defined as securing the cap in an air tight manner, typically by imparting an additional twist to the cap 16. As best depicted in FIG. 5, the product is then partially cooled on specially designed cooling racks 30, using spray 32 of room-temperature (~25° C.) water, thereby producing cooling induced volumetric contraction of the liquid and vapor in the containers which produces a vapor lock, thereby causing the pop-up portion of the pop-up cap to become depressed (not shown) indicating a positive seal. Once a vapor lock is achieved, the containers are allowed to further cool at ambient conditions to room temperature (approximately 35° C.).

Figure 6:
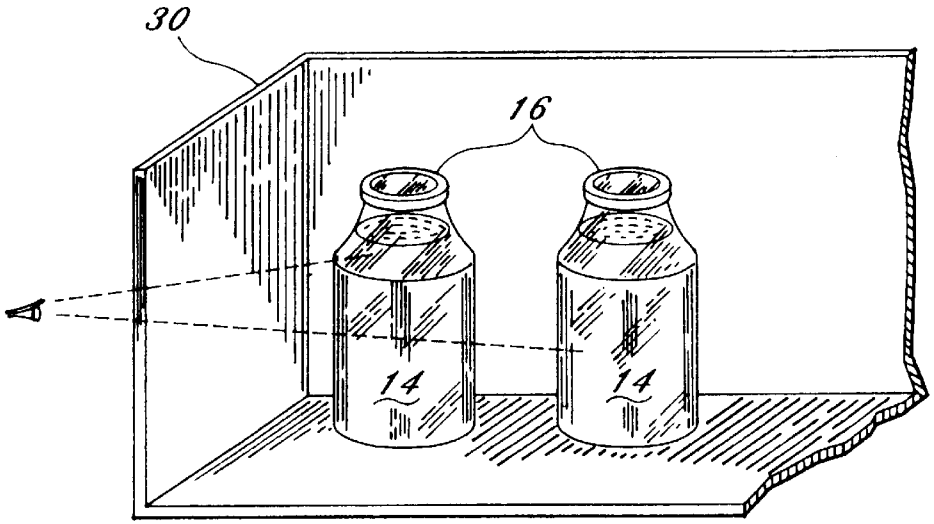
FIG. 6 illustrates the containers during the stabilization and inspection stage.

As best illustrated in FIG. 6, the product should then be allowed to stabilize for approximately three days, during which time the product undergoes quality control inspections to detect any fermentation, contamination, leaks, or defects in the vapor lock seal.

Figure 7:
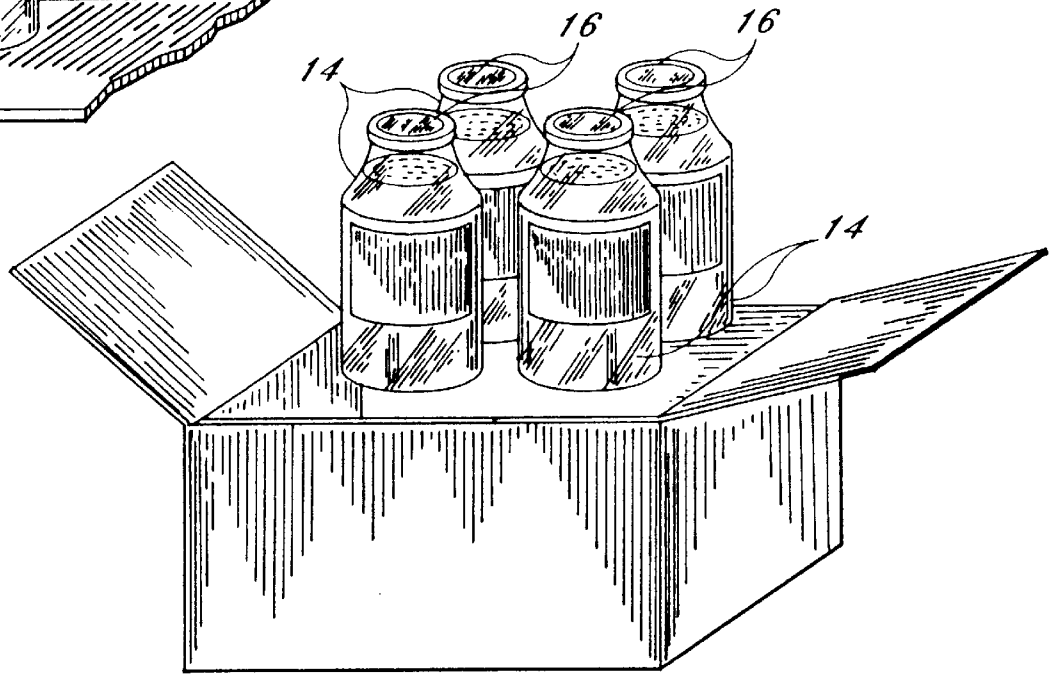
FIG. 7 illustrates the final labeling and packaging stage.

The resulting product is then labeled, boxed and shipped for consumption as illustrated in FIG. 7. Product made by the instant process has an extended shelf life of over 2 years without refrigeration.

Figure 11:
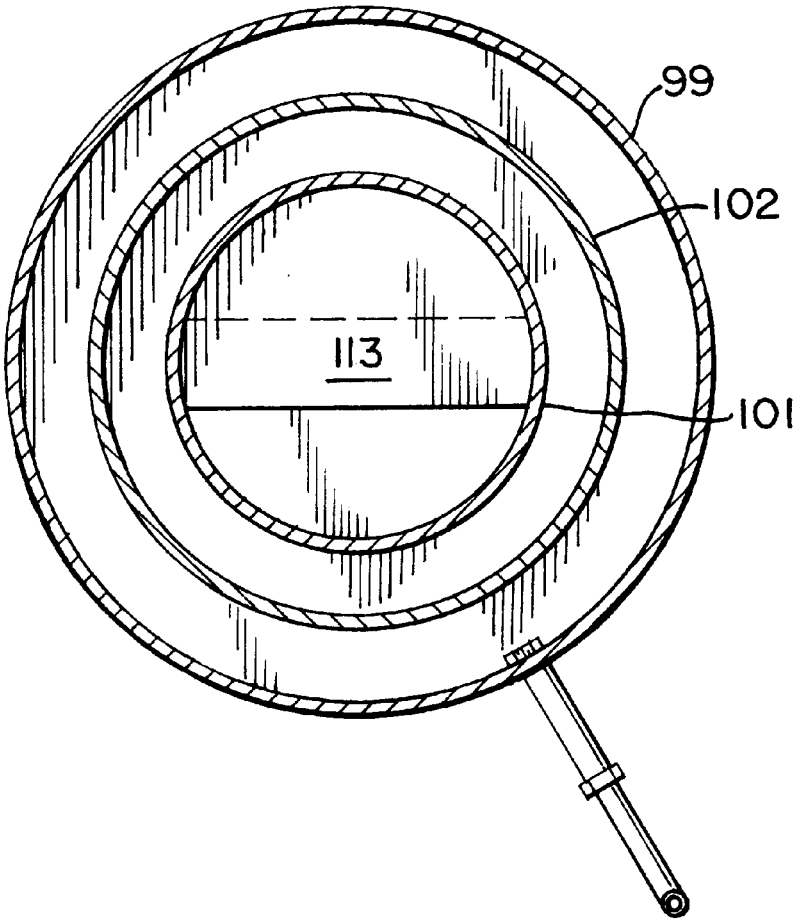
FIG. 11 is a side, cross-sectional view of the tank and surrounding layers shown in FIG. 9.

FIGS. 9 and 11 depict an industrial apparatus and related method for the preservation of large volumes of perishables. The industrial apparatus and method prevent discoloration resulting from oxidation in a conventional manner using an industrial method which can be modified to suit each product.

Perishables 100 are placed in holding tank 105. Holding tank 105 is preferably made from a material such as stainless steel. From holding tank 105, perishables 100 can be moved to tank 101. Pump 106 can be included in the connection between holding tank 105 and tank 101 to help move perishables 100. Holding tank 105 can include a means for mixing perishables 100 such as an agitator 107. The preferred embodiment of the industrial apparatus includes tank 101. Tank 101 holds perishables 100 for processing. Tank 101 can be made of any industrial food approved material that can resist the required temperatures. Jacket 102 surrounds tank 101. Heating medium 103 fills jacket 102 to surround tank 101. Heating medium 103 transfers heat with perishable 100 through the walls of tank 101. Heating medium 103 is preferably a liquid having a high-thermal capacity between room temperature and the boiling point of the perishable, generally twenty-five to one-hundred degrees centigrade (25–100° C.). Preferred heating mediums 103 include water, ethylene glycol, and mineral oil. Heat source 104 directly heats heating medium 103. Heat source 104 can have a temperature above one-hundred degrees centigrade (100° C.) because heat source 104 does not directly contact perishable 100. Preferred forms of heat source 104 include steam boilers and heating coils.

Once in tank 101, perishables 100 are heated through the walls of tank 101 by heating medium 103. Heating medium 103 is heated by heat source 104. Perishables 100 are heated in tank 101 to a temperature between ninety-two and ninety-seven degrees centigrade (92–97° C.) for a period of time between one and two minutes (1–2 min.).

FIG. 10 is a table showing the effect of heating perishables 100 to different temperatures. The experiments show that the heating of products of temperatures approaching one-hundred degrees centigrade (100° C.) denatures the enzymes within these products which prevents these same enzymes from spoiling the products. The data in FIG. 10 shows that the percentage of inactivation of enzymes depends on the temperature to which the product is heated.

Additional experiments have shown that heating products above 100° C. also deactivate enzymes, but at the cost of taste, color, and aroma. When heated above the boiling point, the taste of perishables 100 is irreversibly changed. After boiling, the color becomes brown and the taste and aroma are changed.

Tank 101 is connected to filler 108. Filler 108 hot fills containers 109 with processed perishables 100 while perishables 100 are still above room temperature. Pump 114 is preferably a centrifugal pump that moves perishables 100 from tank 101 to filler 108. Containers 109 are preferably made out of material that withstands temperatures of at least one-hundred degrees centigrade (100° C.) such as thermoplastic and glass.

A means for transporting containers 109 such as a conveyor belt 115 transfers containers 109 to capper 110. Capper 110 places cap 111 on each of containers 109 while perishables 101 are still hot within containers 109. A means for cooling containers 109 such as water spray 112, cold air (not shown), or cooling tunnel cool containers 109 and perishable 100 causing the contents of containers 109 to volumetrically contract. This creates a vacuum seal within containers 109. The vacuum seal can be monitored to verify freshness and seal of the bottled perishable.

Tank 101 can also include a means for increasing heat transfer. The means for increasing heat transfer can include baffles 113, agitator (not shown), and villi (not shown). The means for increasing heat transfer is designed to increase the transfer of heat between heating medium 103 and perishables 100. By making heat transfer more even and more efficient, perishables 100 can be processed quicker without overheating localized portions of perishables 100. Without means for increasing heat transfer, larger applications where the surface area to volume ratio of tank 101 is low may be impossible to heat evenly. Baffles 113 and agitators (not shown) within tank 101 increase mixing and cause perishables 100 to be evenly heated. Villi (not shown) are finger-like extensions that increase the surface area to volume ratio and thereby facilitate heat transfer.

A preferred form of this industrial apparatus can be used in a batch process. Generally, in batch processes, one allotment is processed at a time. In this invention, tank 101 is filled with perishables 100 and perishables are processed, then tank 101 is emptied. Once emptied, the process is repeated.

Another preferred form is a continuous process. In a continuous process, a constant flow of perishables is maintained throughout the system. To permit a continuous process in which the perishables exit tank 101 having all been adequately heated but not overheated, the mixing in and flow rate through tank 101 must be adjusted.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An apparatus for the aseptic processing of a perishable without preservatives, comprising:

a tank capable of holding said perishable, said tank having an inlet and an outlet for receiving and discharging the perishable;

a first jacket surrounding said tank;

a second jacket surrounding said first jacket;

a first heating medium at least partially filling a volume between said tank and said first jacket that can exchange heat through said tank with said perishable;

a second heating medium filling a volume between said first jacket and said second jacket; and a means for heating said second heating medium so that said second heating medium exchanges heat with said first heating medium, which in turn raises the temperature of the perishable within the tank.

2. The apparatus of claim 1, wherein the first heating medium is chosen from the group consisting of water, ethylene glycol and mineral oil.

3. The apparatus of claim 1, further including means for increasing heat transfer between the first heating medium and the perishable.

4. The apparatus of claim 3, wherein the means for increasing heat transfer includes an agitator in said tank.

5. The apparatus of claim 3, wherein the means for increasing heat transfer includes a baffle disposed within the tank.

6. The apparatus of claim 3, wherein the means for increasing heat transfer includes at least one fin disposed within the tank.

7. The apparatus of claim 3, wherein the means for increasing heat transfer includes an agitator, at least one baffle and at least one heat transfer fin disposed within the tank.

8. The apparatus of claim 1, in which 100% of the enzymes within the perishable are de-natured.

9. The apparatus of claim 1, wherein the perishable are selected from the group consisting of fruit juice, fruit juice blends, fruit pulp, wines, milk, chocolate milk, butter, yogurt, cultured milk products, beer, malt and oat beverages, soups, water and soft drinks.

10. A method for the aseptic processing of a perishable without preservatives utilizing a tank capable of holding the perishable, said tank having an inlet and an outlet for receiving and discharging the perishable, a first jacket surrounding the tank, a second jacket surrounding the first jacket, a first heating medium filling a volume between said tank and said first jacket that can exchange heat through said tank with said perishable, a second heating medium filling a volume between said first jacket and said second jacket, and a means for heating said second heating medium, the steps comprising:

placing a quantity of the perishable in the tank;

causing said means for heating to raise the temperature of the second heating medium, to in turn raise the temperature of the first heating medium for a sufficient duration to raise the temperature of the perishable in the tank to a temperature between 92 and 100 degrees centigrade.

11. The method of claim 10, wherein the perishable is maintained at a temperature between 92 and 100 degrees centigrade for between one and five minutes.

12. The method of claim 10, wherein the perishable is maintained at a temperature between 92 and 100 degrees centigrade for a period of time between one and two minutes.

13. The method of claim 10, further including the step of removing the perishable from the tank after heating the perishable to a temperature between 92 and 100 degrees centigrade.

14. The method of claim 10, wherein the perishable is caused to continuously flow through the tank from an inlet of the tank to an outlet of the tank while being heated to a temperature between 92 and 100 degrees centigrade.

15. The method of claim 10, wherein the perishable are selected from the group consisting of fruit juice, fruit juice blends, fruit pulp, wines, milk, chocolate milk, butter, yogurt, cultured milk products, beer, malt and oat beverages, soups, water and soft drinks.

16. The method of claim 10, in which 100% of the enzymes within the perishable are de-naturated.

17. The method of claim 10, wherein the perishable selected from the group consisting of fruit juice, fruit juice blends, fruit pulp, wines, milk, chocolate milk, butter, yogurt, cultured milk products, beer, malt, and oat beverages, soups, water and soft drinks is placed into containers capable of withstanding temperatures greater than 100 degrees celsius.

18. The apparatus of claim 3, wherein the perishable selected from the group consisting of fruit juice, fruit juice blends, fruit pulp, wines, milk, chocolate milk, butter yogurt, cultured milk products, beer, malt, and oat beverages, soups, water and soft drinks is placed into containers capable of withstanding tempertures greater than 100 degrees Celsius.

* * * * *